US006685453B2

(12) United States Patent
Oehman, Jr. et al.

(10) Patent No.: US 6,685,453 B2
(45) Date of Patent: Feb. 3, 2004

(54) FLUID TRANSFER MACHINE WITH DRIVE SHAFT LUBRICATION AND COOLING

(75) Inventors: Robert E. Oehman, Jr., Raleigh, NC (US); William Power, Greeneville, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 10/160,835

(22) Filed: May 31, 2002

(65) Prior Publication Data

US 2003/0059329 A1 Mar. 27, 2003

Related U.S. Application Data

(60) Provisional application No. 60/298,301, filed on Jun. 14, 2001.

(51) Int. Cl.[7] ..... F01C 21/04

(52) U.S. Cl. ..... 418/102; 418/206.3; 418/206.8

(58) Field of Search ..... 418/102, 206.3, 418/206.8

(56) References Cited

U.S. PATENT DOCUMENTS

| | | | | |
|---|---|---|---|---|
| 1,460,875 A | | 7/1923 | White | |
| 1,927,749 A | * | 9/1933 | Kimming | 418/102 |
| 2,526,964 A | | 10/1950 | Muller | |
| 2,940,399 A | | 6/1960 | Zieg et al. | |
| 2,998,783 A | * | 9/1961 | Lee | 418/102 |
| 3,363,577 A | * | 1/1968 | Heijnis | 418/102 |
| 3,368,799 A | | 2/1968 | Sluijters | |
| 3,450,052 A | * | 6/1969 | Turner et al. | 415/72 |
| 3,994,634 A | | 11/1976 | Riddle et al. | |
| 4,038,000 A | | 7/1977 | Dworak | |
| 4,548,557 A | | 10/1985 | Janczak | |
| 5,083,909 A | | 1/1992 | Kansemiller et al. | |
| 6,048,185 A | | 4/2000 | Ishizuka et al. | |
| 6,109,900 A | | 8/2000 | Ishizuka et al. | |
| 6,123,531 A | | 9/2000 | Blume et al. | |
| 6,134,911 A | | 10/2000 | Kishimoto et al. | |

FOREIGN PATENT DOCUMENTS

| | | | | |
|---|---|---|---|---|
| CH | 0133559 | * | 6/1929 | 418/102 |
| DE | 563 101 | | 11/1932 | |

OTHER PUBLICATIONS

60/298,301 Oehman et al., Fluid Transfer Machine with Drive Shaft Lubrication and Cooling filed Jun. 14, 2001.

Copy of the European Search Report in corresponding European Application No. 02254183.

* cited by examiner

*Primary Examiner*—Thomas Denion
*Assistant Examiner*—Theresa Trieu
(74) *Attorney, Agent, or Firm*—Christopher H. Hunter

(57) ABSTRACT

A fluid transfer machine includes a positive displacement, rotary-type pumping mechanism driven by a drive shaft. The drive shaft is lubricated and cooled by locating the drive shaft in a primary flow path in the machine. Fluid is directed from the inlet through a passage that intersects a cavity surrounding the drive shaft, at a location between a pair of journal bearings. The fluid then continues directly to the suction side of the pumping mechanism. The drive shaft could also be located on the pressure side of the pumping mechanism. The primary flow cools and lubricates the drive shaft and drive shaft bearings, and reduces the size and complexity of the machine, as additional cooling and lubrication flow passage(s) are not required.

14 Claims, 4 Drawing Sheets

FLUID TRANSFER MACHINE WITH DRIVE SHAFT LUBRICATION AND COOLING

CROSS-REFERENCE TO RELATED CASES

The present application claims the benefit of the filing date of U.S. Provisional Application Ser. No. 60/298,301, filed June 14, 2001, the disclosure of which is expressly incorporated herein by reference.

BACKGROUND OF THE INVENTION

The present invention relates generally to a fluid transfer machine, and more particularly to a fluid transfer machine that can be used as a pump or motor.

Fluid transfer machines can have different types of pumping mechanisms to move fluid through the machine. One type of pumping mechanism useful for a variety of fluid transfer machines is a positive displacement rotary pump. Conventional positive displacement rotary pumps include single rotors (vane, piston, progressing cavity, screw or peristaltic), or multiple rotors (internal/external gear, lobe, circumferential piston or screw). The mechanisms all have advantages and drawbacks, depending on the fluid to be pumped, and the particular application.

During movement of the pumping mechanisms, friction can cause wear and heating of the moving parts, which can degrade the machine over time, and lead to failure and/or costly and time-consuming repairs.

Fluid is typically used for lubricating the moving parts of the pumping mechanism. It is particularly advantageous to use a portion of the fluid being transferred through the machine as the cooling and lubricating fluid. It is well-known to provide additional flow passages through the housing of the machine and to tap or bleed off a portion of the fluid from the primary flow for use in lubrication and cooling. It is also known to intentionally provide leak paths between the moving components and then collect the fluid for return to the primary flow path. Examples of such machines are shown in Ishizuka, U.S. Pat. No. 6,048,185; Riddle, U.S. Pat. No. 3,994,634; and Zieg, U.S. Pat. No. 2,940,399.

It is also known to provide grooves in rotating shafts to assist in moving the cooling and lubrication fluid between the components in the fluid transfer machine, such as shown in Sluijters, U.S. Pat. No. 3,368,799.

While the machines shown and described above are useful in some applications, forming (e.g., drilling) the flow passages in the machine to direct the cooling and lubricating fluid to the various components can be labor-intensive and difficult. A number of angled passages are typically required, which requires multiple drilling steps. This is shown particularly in Janczak, U.S. Pat. No. 4,548,557, where complex passages requiring multiple drilling steps are used to avoid connecting the primary fluid flow path directly with the drive shaft. Janczak points out that high pressure fluid around the drive shaft could damage or weaken the seals along the shaft.

Providing such complex passages also increases the size of the machine and the space necessary for locating the machine in the fluid transfer system. With the demand for smaller and lighter pumps and motors, and smaller fluid transfer systems, it has become increasingly difficult to manufacture such machines in a cost-effective, compact manner, particularly for high-performance applications which require high flow rates.

One partial solution is shown in Dworak, U.S. Pat. No. 4,038,000, where the primary flow path through the machine is directed from the inlet, through the gear mechanism (stub shafts and bearings), to the outlet. There are no additional lubrication and cooling passages for the bearings and stub shafts, beyond what is used to direct the primary flow through the machine. The Dworak machine has the advantage in that the machine is smaller and easier to construct, and keeps the pumping mechanism properly lubricated and cooled. Nevertheless, the Dworak machine does not address friction and wearing of the drive shaft, as the primary flow path in Dworak is limited to only the stub shaft and associated bearings. The drive shaft is also rotating, and particularly in high-performance applications, also has friction and wear issues.

Thus, it is believed there is a further demand for an improved fluid transfer machine, particularly a machine that can be used as a pump or motor, where the drive shaft is properly lubricated and cooled, and which has a compact design that is easily-manufactured.

SUMMARY OF THE INVENTION

The present invention provides a novel and unique fluid transfer machine, particularly useful as a pump or motor, where the drive shaft (as well as the pump mechanism) is properly lubricated and cooled, and which has a compact design that is easily-manufactured.

According to the present invention, the fluid transfer machine has a pumping mechanism that is a positive displacement, rotary (single or multiple rotor) type pump appropriate for the particular application. An external gear-type pump is used in a preferred form of the invention. The machine can be run as a motor or as a pump, as should be well know, typically by reversing the rotation of the pumping mechanism.

The pumping mechanism includes a typical arrangement of components such as bearings and stub shafts, which are preferably lubricated in a conventional manner, such as by allowing a slight leak path between the moving components.

The pumping mechanism is driven by a drive shaft, which extends out of the housing and is acted upon by (or acts upon) an external device. To lubricate and cool the drive shaft, and in particular the portion of the drive shaft internal to the housing, the drive shaft is located in the primary flow path through the fluid transfer machine. In a preferred embodiment, the drive shaft is located in the inlet flow path of the primary flow. The primary flow is directed from the inlet port to a cavity that surrounds the drive shaft, at a location between a pair of journal bearings or sleeves. The flow then continues to the suction side of the pumping mechanism. Alternatively, the drive shaft could be located in the outlet flow path of the primary flow path, between the pressure side of the pumping mechanism and the outlet port. In either case, the primary flow cools and lubricates the drive shaft (and drive shaft bearings), and reduces the size of the fluid transfer machine, as additional cooling and lubrication flow passage(s) are not necessary. This also reduces the complexity of manufacture of the machine.

The present invention thereby addresses many of the issues with prior machines, and provides a fluid transfer machine, particularly useful as a pump or motor, where the drive shaft (as well as the pump mechanism) is lubricated and cooled, and which has a compact design that is easily-manufactured.

Further features of the present invention will become apparent to those skilled in the art upon reviewing the following specification and attached drawings

DETAILED DESCRIPTION OF THE PREFERRED EMBODIMENT

Figure 1:
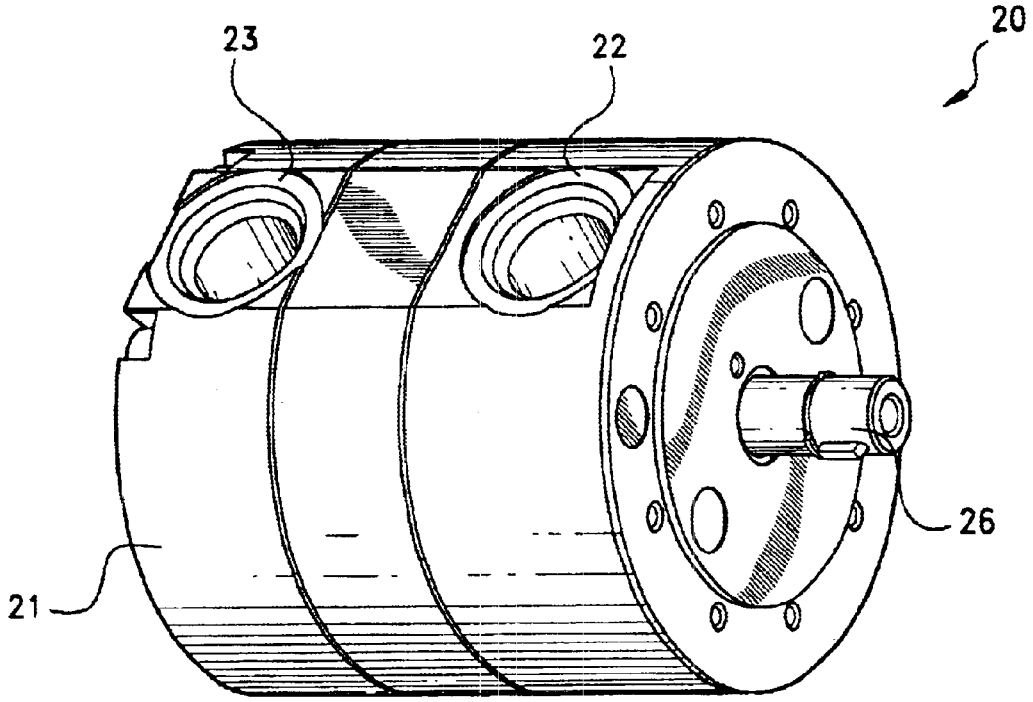
FIG. 1 is an elevated perspective view of a positive displacement rotary fluid transfer machine constructed according to the principles of the present invention.
Figure 2:
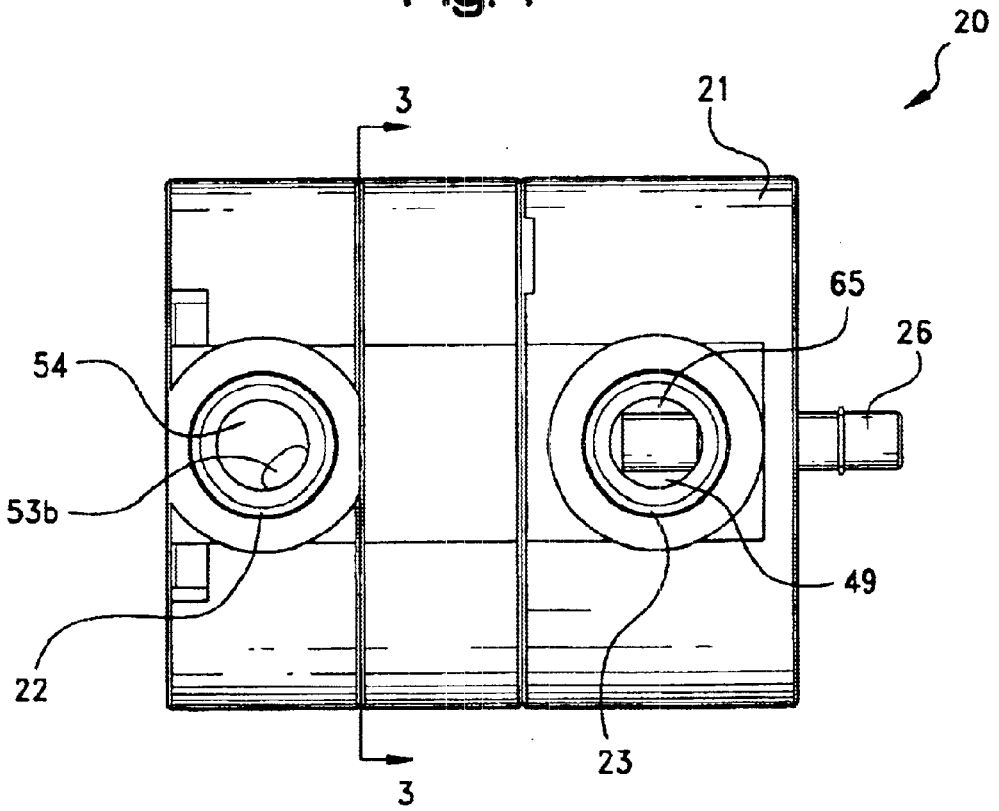
FIG. 2 is a side view of the machine of FIG. 1.
Figure 3:
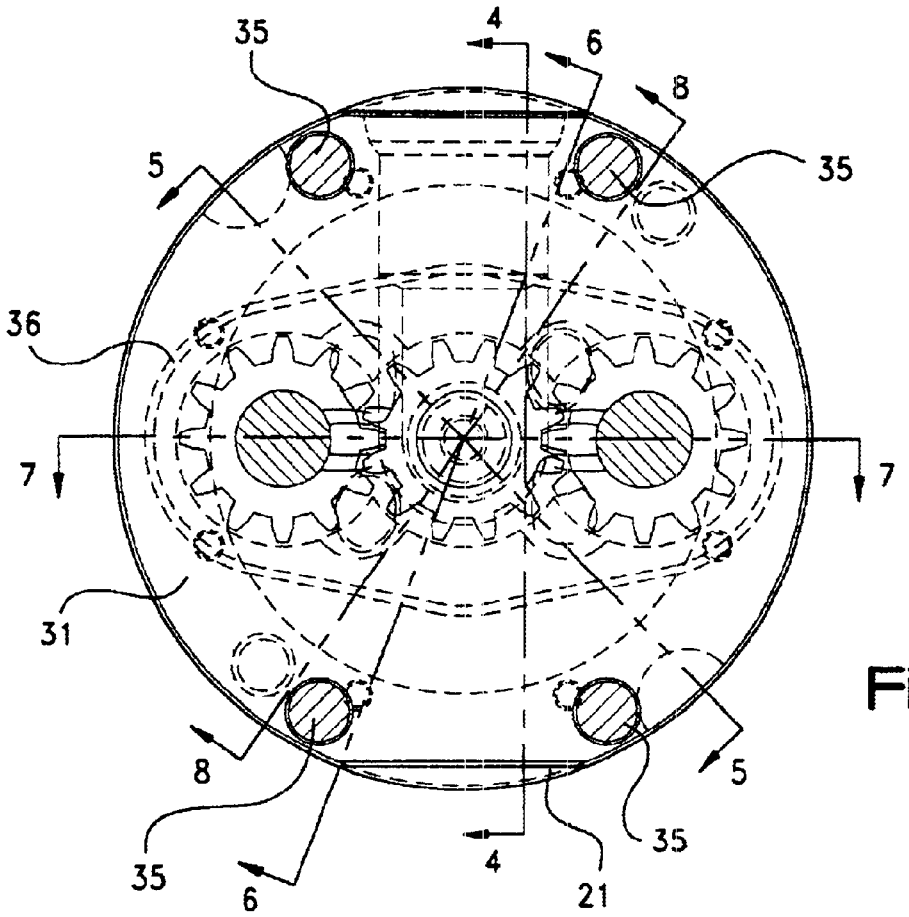
FIG. 3 is a cross-sectional end view of the machine taken substantially along the plane describe by the lines 3—3 of FIG. 2.
Figure 4:
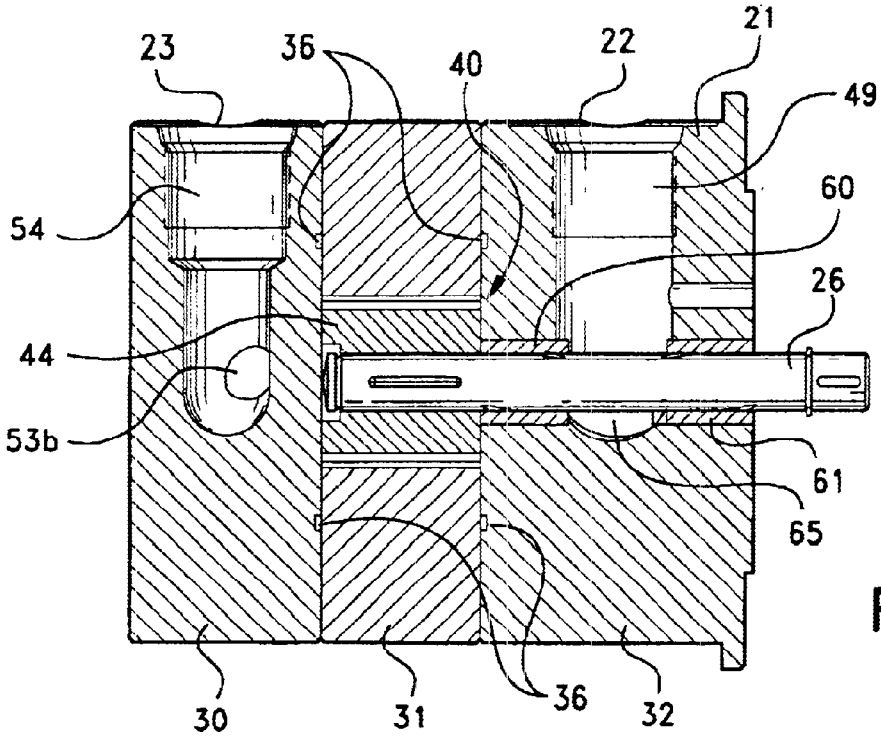
FIG. 4 is a cross-sectional side view of the machine taken substantially along the plane describe by the lines 4—4 of FIG. 3.
Figure 5:
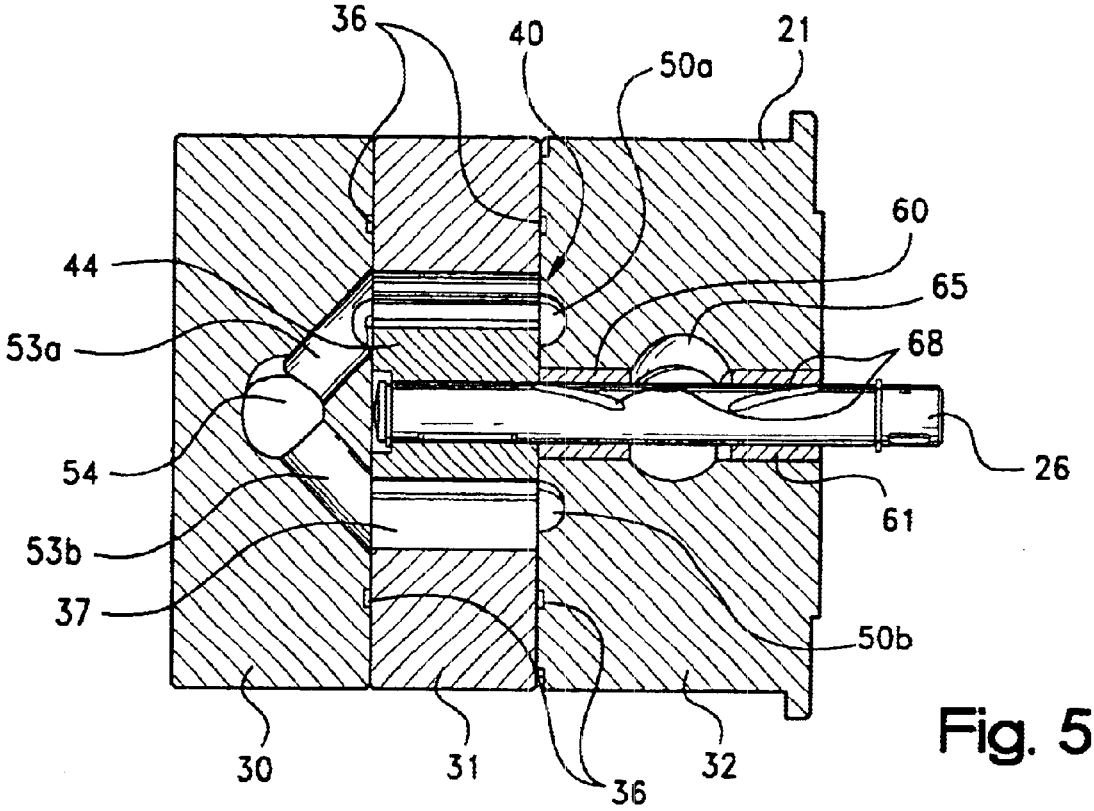
FIG. 5 is a cross-sectional side view of the machine taken substantially along the plane describe by the lines 5—5 of FIG. 3.
Figure 6:
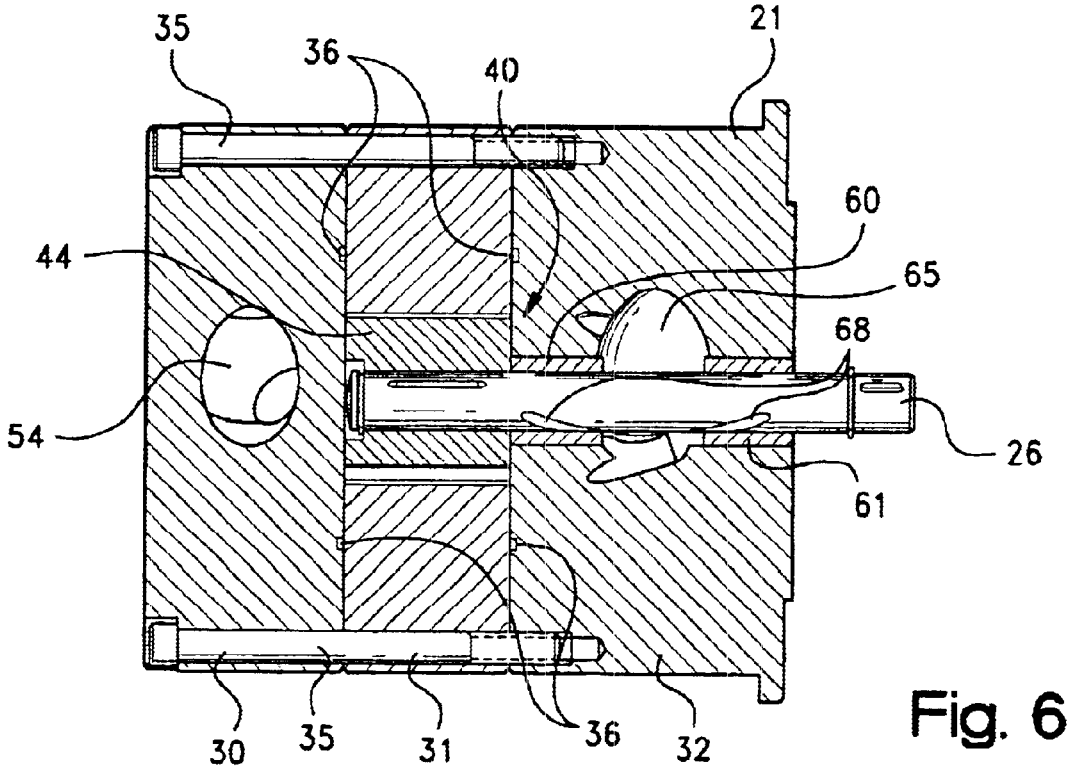
FIG. 6 is a cross-sectional side view of the machine taken substantially along the plane describe by the lines 6—6 of FIG. 3.
Figure 7:
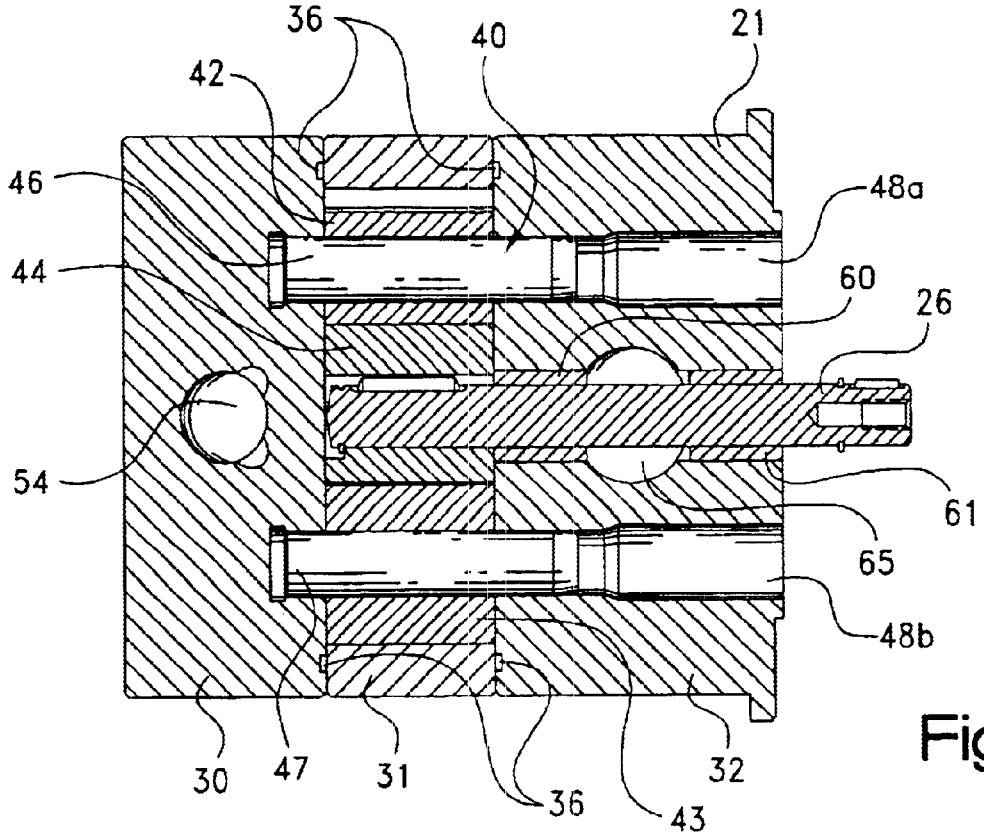
FIG. 7 is a cross-sectional side view of the machine taken substantially along the plane describe by the lines 7—7 of FIG. 3.
Figure 8:
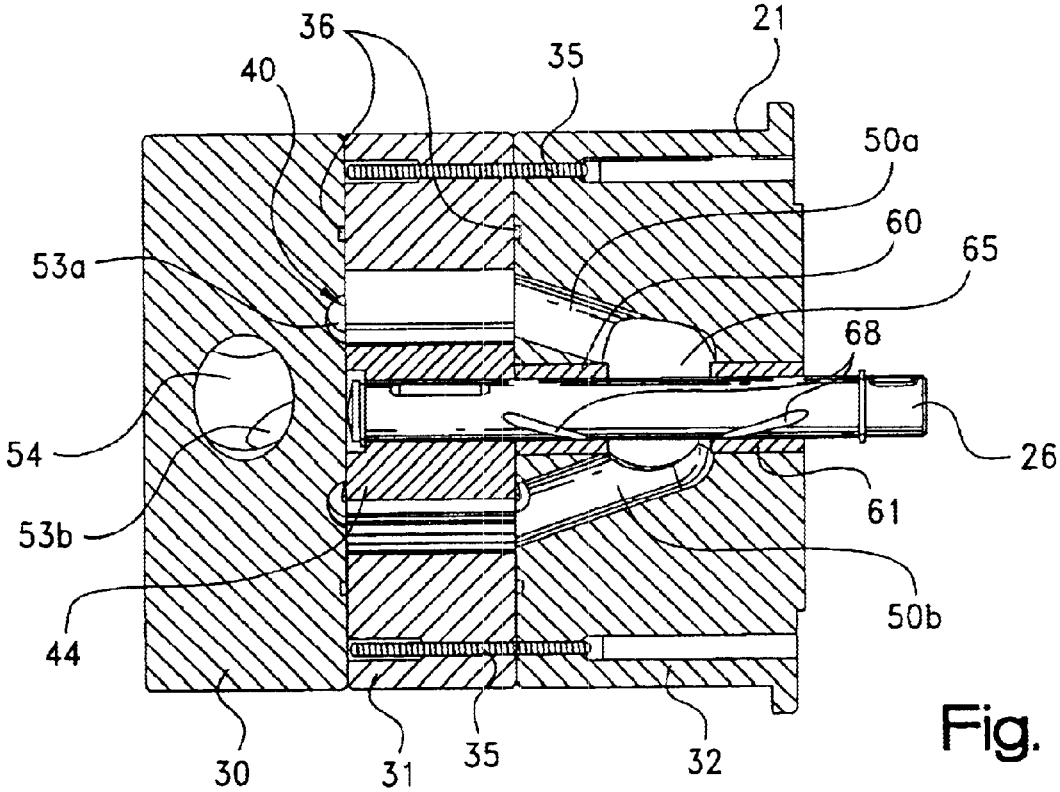
FIG. 8 is a cross-sectional side view of the machine taken substantially along the plane describe by the lines 8—8 of FIG. 3.

Referring to the drawings, and initially to FIGS. 1 and 2, a positive displacement, rotary-type fluid transfer machine is indicated generally at 20. The machine has a housing or body 21, with a first, inlet port 22, and a second, outlet port 23. A drive shaft 26 projects outwardly from the housing and can be rotated to operate a pumping mechanism internal to the housing.

While a preferred form of machine will be described herein, it is to be noted that the machine could have any type of positive displacement rotary-type pump such as a single rotor (e.g., vane, piston, progressing cavity, screw or peristaltic); or multiple rotor (e.g., internal/external gear, lobe, circumferential piston or screw) pump. It should also be well-known that the machine could be operated as a pump or a motor, depending on the rotation of the drive shaft 26, and the connections to ports 22 and 23.

As can be seen in FIGS. 3–8, the housing 21 consists of three cylindrical sections 30, 31 and 32, which are arranged end-to-end in a conventional manner, and screwed together such as with elongated bolts 35. Inlet port 22 is provided in end section 32, while outlet port 23 is provided in end section 30. It is noted that inlet and outlet ports 22, 23 could alternatively be formed in only one of the sections and/or in middle section 31, or could be located at one or both of the axial ends of the housing. In any case, appropriate seals 36 are provided between the sections to prevent fluid leakage.

Middle section 31 includes a central chamber 37, which receives a pumping mechanism, indicated generally at 40. Chamber 37 is closed at either end by opposing end surfaces of sections 30 and 32. Pumping mechanism 40 preferably comprises an external gear-type mechanism, with three gears 42, 43, 44 supported for rotation on stub shafts 46, 47, and drive shaft 26, respectively (see, e.g., FIG. 7). Stub shafts 46, 47 are closely received, preferably with press-fit, in blind end bores 48*a*, 48*b*, respectively, extending inwardly from one end of the housing, such that shafts 46, 47 are prevented from rotating relative to the housing. Gears 42, 43 are received for rotation on stub shafts 46, 47; while drive shaft 26 is received with a key-in-groove or is fixed by other appropriate means to central gear 44. Gear 44 is interposed between gears 42 and 43, such that gears gear pair 42, 44 have teeth that intermesh during rotation, and gear pair 43, 44 also have teeth that intermesh during rotation. When drive shaft 26 is rotates, central gear 44 rotates both outer gears 42, 43, simultaneously which in turn, create expanding and contracting pockets for transfer of fluid.

Inlet port 22 is fluid connected to the suction side of the pumping mechanism, that is, at a location where the pockets between the gear teeth are expanding. Outlet port 23, in contrast, is fluidly connected to the pressure side of the pumping mechanism, that is, at a location where the pockets in the gear teeth are contracting. To this end, inlet port 22 is fluidly connected to a single inlet passage portion 49, which divides into a pair of passages 50*a*, 50*b*, each of which is fluidly connected to the suction side of each gear pair 42, 44 and 43, 44, respectively. A pair of passages 53*a*, 53*b*, are fluidly-connected to the pressure side of the pumping mechanism, and then combine and lead to a single outlet passage portion 54, which is fluidly connected to outlet port 23. A primary flow path is thereby established from the inlet port 22 through inlet passages 49, 50*a*, 50*b*; through the expanding and contracting pockets of the gears 42–44; and through outlet passages 53*a*, 53*b*, 54 to outlet port 23.

The structure describe above is fairly conventional in three-gear, external gear-type pumping mechanism, as should be appreciated by those skilled in the art. Again, the three-gear pumping mechanism is only exemplary in nature, and other pumping mechanisms could be used, depending upon the particular application. For example, only two intermeshing gears could be provided, with only a single passage leading to the suction side, and a single passage leading from the pressure side; or an entirely different type of pumping mechanism, such as a single rotor (vane, piston, progressing cavity, screw or peristaltic), or other multiple rotor (internal/external gear, lobe, circumferential piston or screw), could be used.

As should be appreciated, small clearances could be included between the moving parts of the pumping mechanism to allow slight leakage. The leakage would enable a thin layer of fluid to enter between the gears and the adjacent walls, and between the stub shafts and the gears, and provide lubrication and cooling of the components.

The present invention provides a means to cool and lubricate the drive shaft during rotation of the gears. The drive shaft is typically supported on annular bearings, such as sleeve or journal bearings 60, 61. Bearings 60, 61 are spaced apart axially along the drive shaft, with bearing 60 located closer to the pumping mechanism, and bearing 61 located closer to the distal end of the drive shaft. A cavity 65 is provided in housing section 32 in surrounding relation to shaft 26, and between the bearings 60, 61. Cavity 65 can be easily formed during the manufacture of the end housing section 32. Cavity 65 is located in the primary flow path and received fluid directly from the inlet passage 49, and then delivers the fluid directly to inlet passages 50*a*, 50*b* to the pumping mechanism.

Fluid entering the inlet port 22 thereby flows through the port and completely surrounds drive shaft 26, where the fluid provides lubrication and cooling of the drive shaft. The fluid seeps through bearings 60, 61, and thereby also provides cooling and lubrication of the drive shaft bearings. Helical or spiral grooves, such as at 68 (FIGS. 5, 6, 8) assist in directing fluid along the shaft to cool and lubricate the shaft, as well as the bearings 60, 61. If necessary or desirable, a fluid seal surrounding shaft 26 can be provided axially outward from outer bearing 61, or a seal could be provided on an external component engaging shaft 26 and sealing against housing section 32 in the area surrounding shaft 26.

Of course, the machine could be operated in a reverse manner, such that port 22 is an outlet port, and the fluid is provided from the pressure side of the pumping mechanism 40 through passages 50*a*, 50*b* to cavity 65, and then to passage 49 and port 22. The direction of rotation of drive shaft 26 determines whether the machine operates as a pump or motor, as should be well-known to those skilled in the art.

In any case, as described above, the present invention addresses many of the issues with prior machines, and provides a fluid transfer machine, particularly useful as a pump or motor, where the drive shaft (as well as the pump mechanism) is lubricated and cooled, and which has a compact design that is easily-manufactured. The primary flow path is used to cool and lubricate the drive shaft (and drive shaft bearings) without the need for additional passages through the housing.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A fluid transfer machine, comprising:

a housing including a first fluid port and a second fluid port, and enclosing a pumping mechanism, a primary flow path defined from the first port through the pumping mechanism to the second port, a drive shaft engaging the pumping mechanism and extending outwardly from the housing, the drive shaft rotatable to operate the pumping mechanism and transfer fluid from the first port to the second port through the primary flow path, wherein the drive shaft is located in the primary flow path through the housing, and wherein a cavity surrounds a portion of the drive shaft, and the primary flow path is defined through the cavity, and a pair of bearings support the drive shaft and are spaced apart along the drive shaft, the cavity being located between the bearings.

2. The fluid transfer machine as in claim 1, wherein the housing includes housing sections disposed in end-to-end relation to one another, the housing sections including a middle housing section and a pair of end sections on opposite sides of the middle section, the pumping mechanism being located in a chamber in the middle housing section, and the cavity and bearings being located in one of the end sections.

3. The fluid transfer machine as in claim 2, wherein a first passage portion fluidly interconnects the first port directly with the cavity, and a second passage portion fluidly interconnects the cavity directly with the pumping mechanism.

4. The fluid transfer machine as in claim 1, wherein the cavity completely surrounds the drive shaft, along a portion of the drive shaft.

5. A pump, comprising:

a housing including a first fluid port and a second fluid port, and enclosing a positive displacement pumping mechanism, a primary flow path defined from the first port through the pumping mechanism to the second port, a drive shaft engaging the pumping mechanism and extending outwardly from the housing, the drive shaft rotatable to operate the pumping mechanism and transfer fluid from the first port to the second port through the primary flow path, wherein the drive shaft is located in the primary flow path through the housing and wherein a cavity surrounds a portion of the drive shaft, and the primary flow path is defined through the cavity, and a pair of bearings support the drive shaft and are spaced apart along the drive shaft, the cavity being located between the bearings.

6. The pump as in claim 5, wherein the housing includes housing sections disposed in end-to-end relation to one another, the housing sections including a middle housing section and a pair of end sections on opposite sides of the middle section, the pumping mechanism being located in a chamber in the middle housing section, and the cavity and bearings being located in one of the end sections.

7. The pump as in claim 6, wherein a first passage portion fluidly interconnects the first port directly with the cavity, and a second passage portions fluidly interconnects the cavity directly with the pumping mechanism.

8. The pump as in claim 5, wherein the cavity completely surrounds the drive shaft, along a portion of the drive shaft.

9. A gear pump, comprising:

a housing including a first fluid port and a second fluid port, and enclosing a set of gears with intermeshing teeth, a primary flow path defined from the first port between the teeth of the gears to the second port, a drive shaft engaging one of the gears and extending outwardly from the housing, the drive shaft rotatable to rotate the gears and pump fluid from the first port to the second port through the primary flow path, wherein the drive shaft is located in the primary flow path through the housing, and wherein a cavity surrounds a portion of the drive shaft, and the primary flow path is defined through the cavity, and a pair of bearings support the drive shaft and are spaced apart along the drive shaft, the cavity being located between the bearings.

10. The gear pump as in claim 9, wherein the housing includes housing sections disposed in end-to-end relation to one another, the housing sections including a middle housing section and a pair of end sections on opposite sides of the middle section, the gear set being located in a chamber in the middle housing section, and the cavity and bearings being located in one of the end sections.

11. The gear pump as in claim 10, wherein a first passage portion fluidly interconnects the first port directly with the cavity, and a pair of passage portions fluidly interconnect the cavity directly with the gear set, and the gear set includes three gears, with a first and second of the gears being rotatable around stub shafts, and a third of the gears being interposed between the first and second gears and directly engaging both the first and second gears, the third gear being driven directly by the drive shaft.

12. The gear pump as in claim 9, wherein the cavity completely surrounds the drive shaft, along a portion of the drive shaft.

13. A method for transferring fluid through a machine, where the machine includes a housing having an inlet port and an outlet port, and encloses a pumping mechanism, a primary flow path defined from the inlet port through the pumping mechanism to the outlet port, a drive shaft engaging the pumping mechanism and extending outwardly from the housing, the drive shaft rotatable to operate the pumping mechanism and transfer fluid from the inlet port to the outlet port through the primary flow path, and a cavity in the primary flow path surrounding the drive shaft, and fluid connected to the inlet port and to the pumping mechanism, the cavity surrounding a portion of the drive shaft, and the primary flow path is defined through the cavity, and a pair of bearings support the drive shaft and are spaced apart along the drive shaft, with the cavity being located between the bearings, wherein the method comprises the steps of: directing fluid into the inlet port of the pump, directing the fluid into the cavity around the drive shaft to cool and lubricate the drive shaft, directing the fluid from the drive shaft to the pumping mechanism, rotating the drive shaft to operate the pumping mechanism, and directing the fluid from the pumping mechanism to the outlet port.

14. The method as in claim 13, wherein the cavity completely surrounds the drive shaft, along a portion of the drive shaft.

* * * * *